United States Patent [19]

Chastang

[11] 4,019,229

[45] Apr. 26, 1977

[54] YARN TEXTURING APPARATUS

[75] Inventor: Pelham D. Chastang, Bay Minette, Ala.

[73] Assignee: Monsanto Company, St. Louis, Mo.

[22] Filed: Sept. 23, 1975

[21] Appl. No.: 615,955

[52] U.S. Cl. ..... 28/1.6; 28/1.7; 242/153

[51] Int. Cl.[2] ..... D02G 1/12

[58] Field of Search ..... 28/1.6, 1.7; 242/153, 242/154

[56] References Cited

UNITED STATES PATENTS

| | | | |
|---|---|---|---|
| 2,556,265 | 6/1951 | Franklin | 242/154 X |
| 2,556,285 | 6/1951 | McDermott | 242/153 |
| 2,595,270 | 5/1952 | Klein | 242/153 |
| 3,394,439 | 7/1968 | McIntyre | 28/1.6 |
| 3,832,759 | 9/1974 | Eskridge et al. | 28/1.6 X |
| 3,936,916 | 2/1976 | Berenstein et al. | 28/1.6 |

FOREIGN PATENTS OR APPLICATIONS

| | | | |
|---|---|---|---|
| 45-21907 | 7/1970 | Japan | 28/1.6 |
| 131,998 | 6/1929 | Switzerland | 242/153 |
| 761,042 | 11/1956 | United Kingdom | 242/153 |

*Primary Examiner*—Robert R. Mackey
*Attorney, Agent, or Firm*—Stanley M. Tarter; John W. Whisler

[57] ABSTRACT

Apparatus is disclosed for texturing thermoplastic continuous filament yarn wherein the distance that the yarn in compacted form moves forward in a texturizer is controlled by a particular device. The device comprises a plurality of stationary elongated juxtaposed yarn guide members arranged generally parallel with respect to the path taken by the compacted yarn and having a cumulative yarn frictional engaging length diminishing in the direction of the movement taken by the yarn in compacted form.

1 Claim, 7 Drawing Figures

YARN TEXTURING APPARATUS

BACKGROUND OF THE INVENTION

The present invention relates to yarn texturing methods and apparatus. More particularly, it relates to yarn texturing using stuffing box techniques.

It is well known to use stuffer box crimpers in the production of textured yarn. In accordance with one stuffer box technique, uncrimped yarn is transported by a pair of counter-rotating nip rolls into and through a confined zone known as a stuffer box. In the box the yarn is caused to be folded and compressed into a fine crimp configuration. The crimp in the yarn is heat set to made it of a lasting nature. The yarn moves through the box in compact plug-like form. In a second stuffer box technique, it has been found advantageous to employ a flow of hot compressible fluid to convey the yarn into and through the box instead of using nip rolls. In order to obtain a more permanent crimp in the yarn, the movement of the yarn through the box is often restricted by suitable counter-pressure means, for instance a flap or a plunger. Where the yarn is advanced vertically upward; the weight of the plug of yarn and surface friction can provide suitable counter-pressures and the use of a flap, plunger or the like is not required. It is quite important that the height of the plug in the confined zone remain uniform and not go above or below predetermined close limits. Otherwise, the crimp and, thus, bulk will vary considerably in uniformity; and the quality of textile articles made from the resulting yarn will be inferior.

There are many causes for the occurrences of plug height variations. Among these causes are unevenness of the denier of the source yarn, buildup of deposit of degraded yarn finish on the inner surfaces of the confined zone defining means, and variations occurring in the rates at which the yarn transport means conveys the yarn into and from the texturing operation.

Quite often the source yarn is first wound on interim bobbins. Such bobbins are stocked on a creel; and the yarn is fed to the texturizer by being withdrawn overend from a bobbin. Obviously, such removal causes a small amount of twist to be imparted to the yarn. Unfortunately, the amount of twist increases in a direct relation to the amount of yarn withdrawn. This variation in twist in yarn moving from the outside of the package to the inside of the package is called "twist bias". With a normal size bobbin of heavy denier yarn, twist varies from 0.02 to 0.05 turn per inch; or, stated another way, there is a 150% increase of twist imparted to the yarn during overend withdrawal from the bobbin. With the increasing amounts of twist, there is a steady and gradual decrease in plug height.

In stuffer box compressive crimping, there are many known devices that sense the yarn plug level by photoelectric cells, pneumatic sensing devices, mechanical sensing devices or combinations thereof and in response control the speed of the driven yarn forwarding rolls or withdrawal rolls. The known plug control devices are quite complex in structure and operation and are expensive to maintain.

Where jet stuffer box texturing is used, it has been suggested in U.S. Pat. No. 3,886,636 to control the plug height level by either adjusting the temperature of the yarn prior to or during the crimping step by varying the temperature of the fluid jetting the yarn into the box in response to a sensed change in plug height level.

This non-isothermal approach for maintaining a uniform plug height level, unfortunately, senses the presence of twist bias as an increase in bulk and responds by reducing the temperature of the fluid. This temperature change causes a real decrease in bulk to maintain the predetermined plug height level resulting in a bulk bias through the package of textured yarn.

An objective accomplished by the present invention is the provision of a stuffer box texturing system wherein the plug height level is maintained by a device of simple construction with no moving parts. Yarns textured by such system have improved uniformity of bulk from one bobbin to another and from the outside to the inside of a given bobbin.

SUMMARY OF THE INVENTION

The novel method of the present invention is useful for texturing thermoplastic continuous filament yarn wherein the length of a plug of stuffer box crimped yarn is controlled within predetermined limits to insure bulk uniformity of the resulting textured yarn. The method includes the steps of moving thermoplastic continuous filament yarn in a crimped or crinkled condition in the form of a compact plug along a line and crimp setting the moving yarn. After crimp setting is accomplished, the yarn is pulled at an abrupt angle from the leading end of the plug. The thus removed yarn is passed into frictional engagement with a plurality of stationary rod-like members and thereby takes a serpentine path. The set crimp pattern of the yarn is thereby tousled; and the tension on the yarn is varied inversely with respect to the distance the yarn plug moves along the line. Finally the resulting textured yarn is collected in an orderly manner.

It is advantageous that the plug of yarn while being crimp set moves through a confined zone such as that provided by a stuffer box of suitable length and cross section configuration. The plug may also be moved along a moving belt or at least partially around a rotating drum where crimp setting is carried out in well known manners. Where the plug of yarn is moved through a confined zone, the transport of such yarn can be accomplished by the use of driven counter-rotating nip rolls.

In a preferred embodiment the transporting of the yarn into and through the confined zone is carried out by the flow of a hot compressible fluid, such as steam or hot air. The use of a hot fluid is a most convenient way of heating the yarn to a sufficiently high temperature required for crimp setting the yarn. Thus, the yarn stuffed by the use of hot fluid needs only to be cooled in order to set the crimp in the yarn. Where nip rolls are employed, the yarn will normally be heated before or during stuffing of the yarn by contact with a heated surface. The movement of the yarn through the confined zone is preferably vertically upward and the back pressure required to crimp the yarn may be provided by the weight of the plug of yarn and the surface friction and the zone. The yarn is fed into the zone and removed at predetermined constant speeds to maintain the level of the plug approximately between established limits. Variations in the yarn due to twist bias and the like which give rise to plug height differences are not compensated for by changing the feeding and/or withdrawal speed of the yarn but rather is accomplished by simply moving the yarn from the leading end of the plug at a sharp angle and then passing the yarn into frictional engagement with a plurality of vertically disposed rod-like members having lengths descending stepwise in the direction of the yarn movement, the yarn thereby assuming a serpentine path. The crimp pattern is thus disarranged to break up the tendency of the crimp in adjacent filaments to be in phase. The height of the plug of the yarn in the confined zone is adjusted in response to the tension on the yarn being varied inversely with respect to the height of the plug.

The apparatus for texturing yarn in accordance with the present invention includes means for longitudinally feeding yarn from a source at a predetermined constant first speed. The feeding means may be a driven roll with or without a separator roll or a pair of nip rolls. In a preferred embodiment the rolls for feeding the yarn are heated in order to better prepare the yarn for the heat setting accomplished in the confined zone. The source of the yarn may be from a bobbin of yarn which may or may not have been drawn to effect molecular orientation. When the yarn is undrawn or partially drawn, the yarn is first stretched before it is crimped. Instead of being collected in an intermediate package form, the yarn may be spun, drawn and textured in one coupled operation.

Means are provided for folding the yarn into a crimped plug-like form. A pair of heated or unheated nip rolls associated with a stuffer box can be used for this purpose. However, preferred is a jet designed to aspirate or pull the yarn into an associated stuffer box. The jet may be designed to entangle the filaments of the yarn to obviate the need of twisting the yarn as may be required when the yarn is converted into textile products, such as carpets. The box is provided with means to cool the yarn so as to complete the required crimp setting of the yarn. Also, the box is provided with a lateral slot or suitable side openings so that the yarn can be pulled at an abrupt angle from the plug of yarn. This can be carried out by the use of a suitably positioned driven roll for forwarding the yarn at a constant second speed at a reduced rate with respect to the yarn feed speed to compensate for yarn retraction and to maintain the level of the yarn plug more or less constant. As indicated above, the level will not as a rule remain constant even though the feed and withdrawal speeds are maintained constant. To adjust for the changes in the height level of the plug, a device is positioned in the yarn path between the point where the direction of the yarn is abruptly changed and the pulling means. The device controls the distance the yarn moves along a line in a folded or plug form and includes a plurality of stationary elongated yarn guide members arranged in juxtaposition generally parallel with respect to such line of movement and having a cumulative yarn engaging length diminishing, preferably stepwise, in the direction of normal yarn movement. The device also breaks up the crimp pattern of the textured yarn.

The device for controlling the distance that the yarn moves in plug form includes a base member. A plurality of closely spaced juxtaposed rod-like yarn guide members have one of each of their ends secured in the base. The guide members have different yarn engaging lengths and are inclined first in one direction and then in the opposite direction so as to receive the yarn therebetween in serpentine engagement. The distal ends of the guide members are preferably bent in the same general direction as the guide members are inclined.

DETAILED DESCRIPTION

Figure 1:
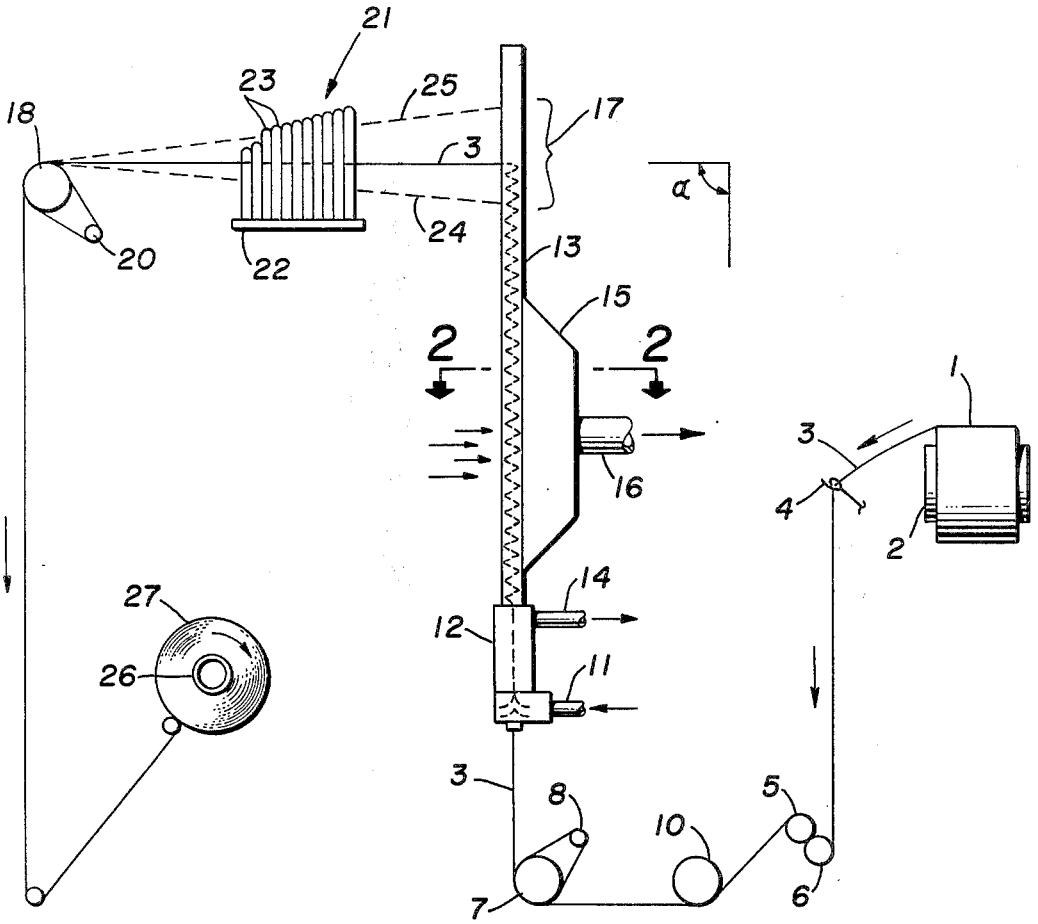
FIG. 1 is a schematic drawing showing a configuration of apparatus for texturing yarn.

With reference to FIG. 1 of the drawings, numeral 1 denotes a package of yarn wound on core 2. The yarn has been spun by conventional means such as by wet spinning, dry spinning or melt spinning and collected in an intermediate package form. As illustrated, yarn 3 forming the package is substantially undrawn, that is to say, the yarn requires an orientation draw to realize optimum tensile properties therefrom. Alternatively, the source yarn may be fully drawn or partially drawn. The yarn may be advanced directly from the spinning operation without being collected as an intermediate package. Yarn 3 is removed overend of package 1 and pulled through pigtail guide 4 by a pair of driven nip-forming feed rolls 5 and 6. Driven draw roll 7 and its associated freely rotatable separator roll 8 pull the yarn at an increased rate of speed as compared to the speed of the yarn exiting the nip of rolls 5 and 6 to stretch the yarn a few times in length. The occurrence of the stretch is localized by draw pin 10 which may or may not be heated. Preferably both roll 7 and pin 10 are heated to preheat the yarn in preparation of texturing it. When the source yarn is already drawn, rolls 5 and 6 and draw pin 10 are not needed.

A hot fluid, such as steam, superheated steam, hot air, hot inert gases and the like moves through conduit 11 from a source not shown. The hot fluid enters jet 12 where the stream of heated fluid acts on yarn 3 to heat it and to aspirate it upwardly through stuffer box or tower 13. The hot fluid is exhausted from jet 12 via conduit 14. The fluid compacts and compresses the yarn in a zig-zag crimp pattern and pushes the crimped yarn vertically upward through stuffer tower 13. Yarn 3 in plug form is cooled to complete the setting of the crimp. This is accomplished by propelling ambient air or other coolant through the yarn via plenum 15 and pipe 16 by vacuum generating means not shown.

In order to assure uniformity of the textured yarn in regard to bulk and dyeability, it is important that the level attained by the top of the plug be maintained within established limits as indicated by bracket 17. Yarn 3 is withdrawn through an open lateral portion of tower 13 at an abrupt angle. As illustrated the path followed by the yarn is generally at right angles with respect to the path of the plug movement through the tower. The angle ($\gamma$) of the path taken by the yarn with respect to the line of plug movement is normally less than 150°, preferably between 60°-120°. The yarn is pulled from the tower by withdrawal roll 18 and its associated separator roll 20 driven at a predetermined constant speed. The peripheral speed of roll 18 is less than the peripheral speed of roll 7 in order to maintain the level or the yarn in the tower in approximately the same position, with due allowance being made for any intrinsic retraction of the yarn during texturing.

Because of variations in the process and in the quality of the source yarn, etc., the plug height level normally may stray outside the desired control limits even though the speeds of roll 7 and roll 18 remain constant during operation and there is no yarn slippage therearound. To control the plug height level, device 21 is placed in the yarn path between roll 18 and the point of yarn withdrawal from tower 13. Device 21 comprises base 22. A plurality of rods 23 extend upwardly from and are securely mounted in base 22. The lengths of rods 23 decrease stepwise in the direction of yarn movement. As will be more apparent in FIGS. 5–7, rods 23 are inclined alternately in one direction and then the other direction to form a slightly crossed configuration for receiving the yarn therebetween. The yarn passes between the rods, turning one way and then the other.

Thus, when the level of the plug height drops, the yarn will tend to assume the path indicated by bottom broken line 24. Thereupon the amount of rod surface in contact with the yarn proportionately increases, thus giving rise to an increase in tension on the yarn between roll 18 and device 21 but a decrease in tension in the yarn between device 21 and tower 13. With such decrease in tension the level of the plug in tower 13 will rise. On the other hand when the level of the plug height rises, the yarn will tend to assume the path indicated by upper broken line 25. The amount of rod surface in contact with the yarn proportionately decreases both because the yarn may not contact the shortest rods and the yarn moves in contact with the upper parts of the rods which diverge because of their slight crossed configuration. With the reduction in surface area contact, the tension on the yarn between roll 18 and device 21 imparted by device 21 decreases; and the yarn is pulled more readily through the device, thus causing the level of the plug to drop.

Finally, the uniformly textured yarn is collected by being wound on core 26 to form package of yarn 27.

Figure 2:
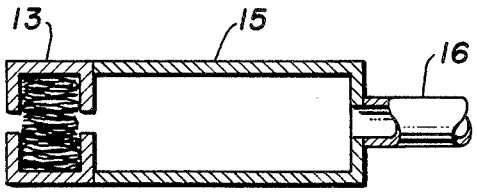
FIG. 2 is a view on an enlarged scale taken along line 2—2 in FIG. 1 of the stuffer box component of the apparatus shown in FIG. 1.

In FIG. 2, it is seen that the yarn is in a wad or plug form having a crimp configuration characteristic of stuffer box crimped yarn. Cooling air moves transversely across the moving plug to set the crimp in the yarn. The crimp configuration is somewhat in phase and thus does not provide optimum bulk. This crimp is dephased by subsequent contact with rods 23 of device 21.

Figure 3:
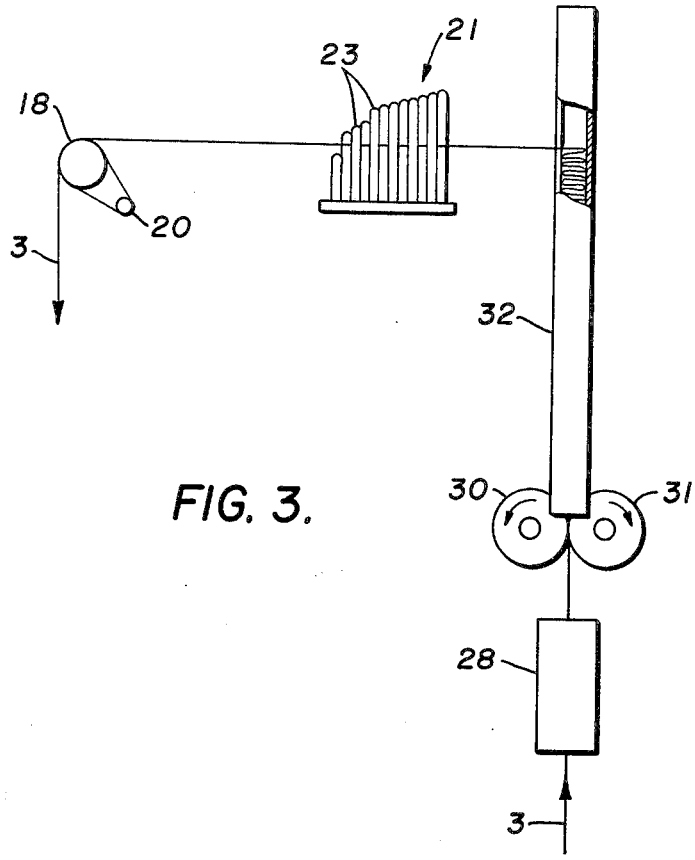
FIG. 3 is a schematic drawing showing the use of a pair of feed rolls for moving the yarn through the stuffer box component of the apparatus of the present invention.

In FIG. 3 a second embodiment of the present invention is illustrated. Drawn yarn 3 passes through heating zone 28 in order to raise the temperature of the yarn to the required texturing temperature. The heating may be accomplished by sliding contact of the yarn with a heated surface. A heated roll may also be used. The suitably heated yarn passes between the nip of stuffer box feed rolls 30 and 31 which cram the yarn into and through elongated stuffer box 32. The yarn becomes compressively crimped. Box 32 may be positively cooled in a suitable fashion. No particular cooling means for doing this is illustrated. The yarn having its crimp pattern heat set moves as a plug through the box and is withdrawn at substantially right angles to the upward moving direction taken by the plug. Roll 18 pulls the yarn from the box at a constant speed correlated with the speed that the yarn is forwarded by rolls 30 and 31. Device 21 is disposed in the yarn path between roll 18 and the top of the advancing plug. As described above, this device provides a cumulative yarn frictional surface that diminishes in the direction of yarn movement through the device and hence controls the level of the plug in the stuffer box.

Figure 4:
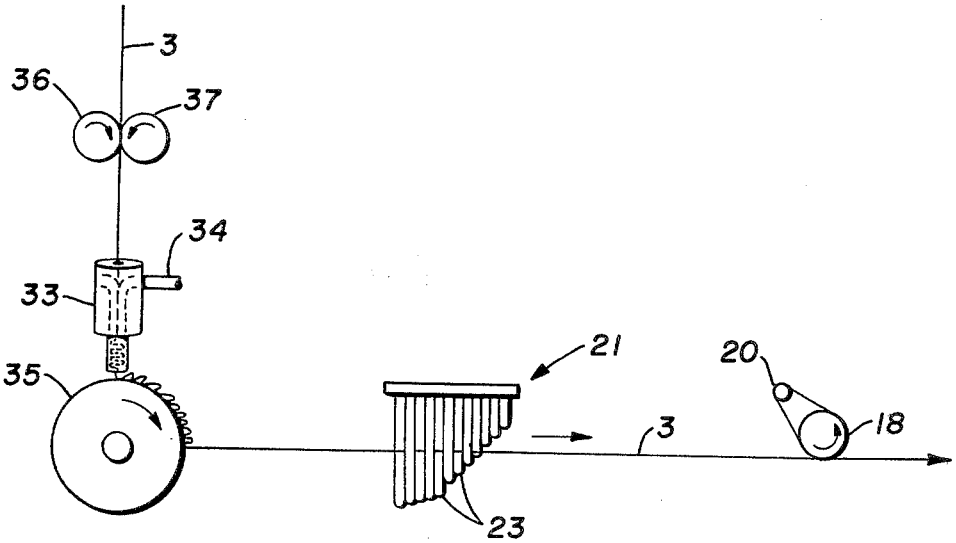
FIG. 4 is a schematic drawing showing a plug length control device used to adjust the length that the plug runs on a foraminous cylinder.

In FIG. 4 a third embodiment of the invention is illustrated. In this embodiment drawn yarn 3 is passed into a downwardly aspirating jet 33. Hot fluid under pressure enters jet 33 via conduit 34. The yarn is crammed into a crimped pattern near the yarn exit of the jet. The yarn exits from the jet in the form of a wad of crimped filaments and moves along rotating drum 35 having a foraminous surface. Vacuum means (not shown) causes ambient air to move through the filamentary mass into the center of the drum and to set the crimp. Roll 18 is driven at a constant speed and synchronized with feed rolls 36 and 37 to permit the wad of yarn to travel along the surface of the drum for a predetermined distance. The drum may be provided with wires, teeth or the like so as to control the travel of the yarn on the drum. Due to variations in the yarn and the process, the distance the wad of yarn actually moves on the drum will vary in practice. To adjust for such variations and to more precisely control the movement of the wad on the drum, device 21 is quite suitable. In this case the yarn moves generally downward and the device will be turned upside down as compared to its position assumed in the first two embodiments.

Figure 5:
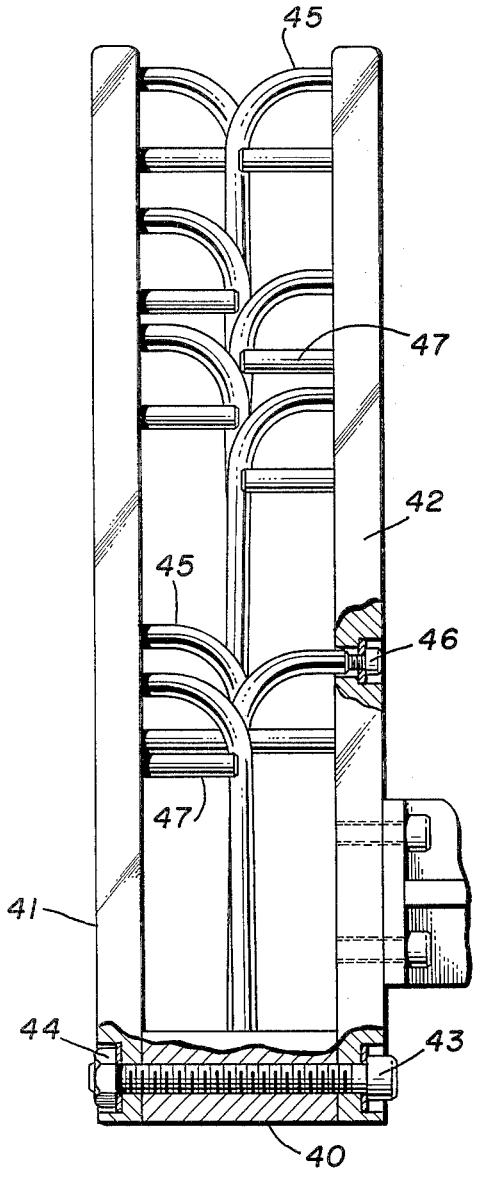
FIG. 5 is an end elevation view showing the stepped bent rods for tensioning the yarn.
Figure 6:
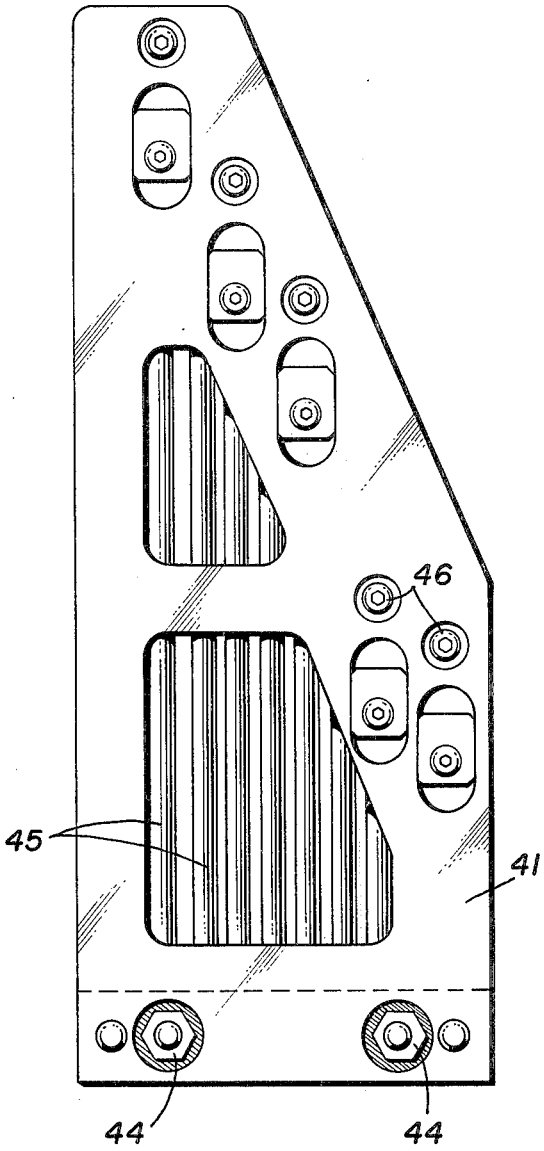
FIGS. 6 and 7 are side elevational views, respectively, showing the two end walls of the plug length control device.
Figure 7:
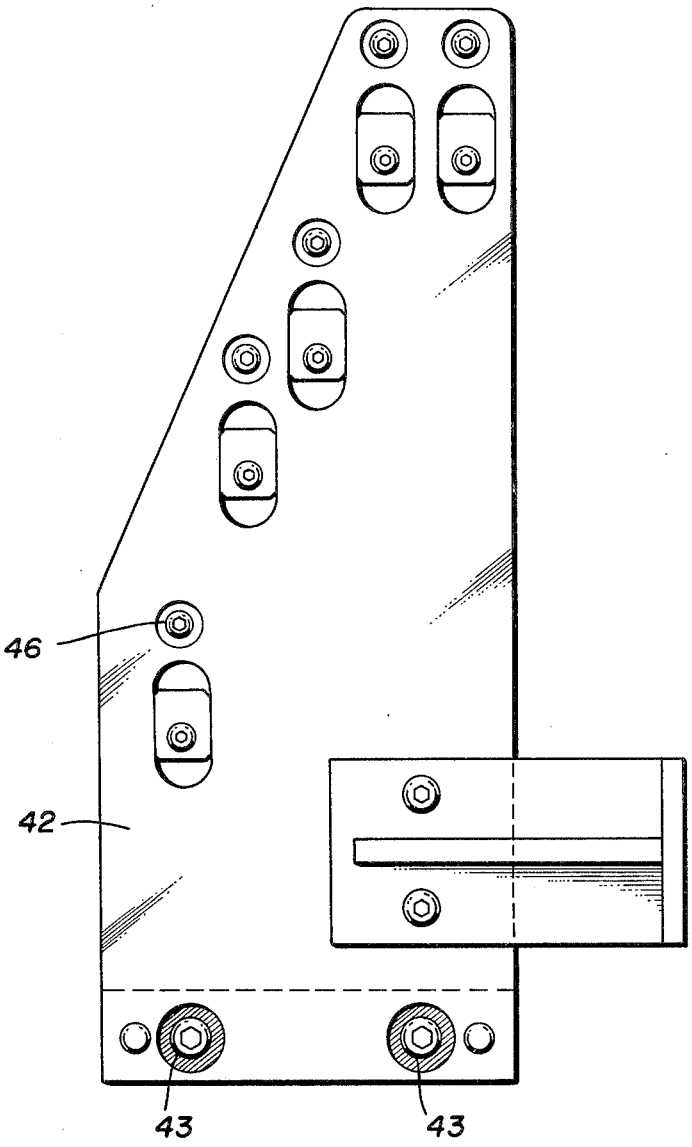

In FIGS. 5–7, device 21 in its preferred construction is shown in detail. The device has base 40 secured to upright wall members 41 and 42 by means of bolts 43 and nuts 44. Embedded in the base in force-fit arrangement are ten rods 45. The points at which the bottom ends of the rods are secured to the base alternately are slightly offset with respect to a horizontal line; and the rods are alternately inclined about 1° from the vertical, first in one direction and then in the other. The ends of the rods are bent and secured alternately in walls 42 and 43 by nuts 46. Studs 47 secured in the walls support the rods in a stationary position. The bending of the rods permits facile stringup of the device by pulling the yarn from a position above the device into engagement with the rods 45. The yarn first contacts the longer rods and progressively contacts additional rods as required to maintain the proper tension on the yarn so as to control the distance the plug of yarn travels. The contact with the rods will tend to fluff up the yarn and hence dephrase the crimp pattern. In practice it has been found that the yarn will nomally engage the first seven rods in its forward movement. However, when the level of the plug of yarn drops below established limits, the yarn will also contact the three shortest rods until the height of the plug assumes its proper position. When the plug height goes above the established upper level limit, the yarn path through device 21 will be in an upper position, under which condition the engagement with some of the first seven rods will no longer occur. This permits the plug to assume a lower level and then the yarn will assume its normal running position in the device.

Yarn textured by the present process may be made from any suitable thermoplastic fiber-forming polymer, copolymer or polymer blends. Among such polymers are: (1) polyamides (also generically called nylons) which are any long chain synthetic polycarbonamides having recurring amide groups as an integral part of the polymer chain; specific examples include polymeric hexamethylene adipamide (nylon-66), polymeric 6-amino caproic acid (nylon-6), polymers of 1,4-cyclohexanedimethylamine and adipic acid (CBMA-6) or dodecanedioic acid (CBMA-12), polymers of 4,4-di(aminocyclohexyl)methane and azelaic acid (PACM-9) or dodecanedioic acid (PACM-12), (2) polyesters which are any long chain synthetic polymer composed of at least 85% by weight of an ester of a dihydric alcohol and terephthalic acid, specific dihydric alcohols including ethylene glycol, 1,4-butane glycol and 1,4-cyclohexanedimethanol, (3) acrylics, (4) modacrylics, (5) polyolefins and (6) cellulose esters.

The yarn may be of any suitable total denier. However, the process has been found to be particularly applicable to heavy denier yarns of 700 denier and above. The yarn may have a round or non-circular cross section, may be made of a multiple of polymer components, and may have various additives incorporated in the polymer to render it antistatic, delustered, flame resistant, dye receptive, etc. Two or more threadlines may be textured together using a common stuffer box.

EXAMPLE

The following illustrates the invention. Nylon-66 yarn was textured using apparatus shown in FIG. 1. The yarn was melt spun using conventional conditions to produce a threadline of substantially undrawn filaments. The threadline was composed of 95 individual filaments and had a total undrawn denier of 5500. The cross section of the filaments was trilobal. The yarn was withdrawn overend from a package and fed to the feed rolls operated at a constant peripheral speed of 353 yards (322.8 meters) per minute. The yarn was then passed several times around a draw pin internally heated to 175° C. From the pin the yarn was passed around a draw roll heated to 185° C. and having a constant peripheral speed of 1200 yards (1097 meters) per minute to provide a draw ratio of 3.4. The drawn yarn was directed into an aspirating jet. The jet forces the yarn upwardly through an elongated stuffer cooling tower to crimp the same. The hot fluid supplied to the jet was steam having inlet pressure of 75 pounds per square inch (5.273 kilograms per square centimeter) and a temperature of 250° C. Ambient air was flowed across the plug of yarn to crimp set it. The rolls used for withdrawing the yarn from the tower were operated at a constant speed of 912 yards (833.9 meters) per minute to provide an overfeed of 24%. The draw textured yarn was collected on a paper tube using a constant tension winder.

The normal end use of yarn of this denier is in the construction of carpets. It is very important in the tufted carpet that all ends of yarn be within acceptable bulk limits, this being ± 1% bulk for better grade yarn. Optical defects will not be manifest in carpets made from yarn having bulk differences substantially within the just-mentioned bulk limits.

The percent bulk was determined for slightly more than 10,000 lbs. (4536 kilograms) of yarn produced by this example. The bulk limits were set to be 29.5 ± 1%. of the yarn had a bulk percentage within the range. This is an extraordinarily high percentage since statistically more than 50% of normal commercially produced textured nylon-66 carpet yarn has bulk value varying greater than ± 1% unless the packages of yarn are segregated based on the result of bulk being determined on each package. The yarn had an average thermal shrinkage of 2.4%.

To determine shrinkage and bulk, a predetermined length of yarn as collected on a bobbin is wound under controlled tension of 0.03 grams per denier onto a reel. The resulting skein is heated in an oven at 180° C. for 5 minutes. After removal from the oven the skein length is measured under various tensions. To do this a first weight is suspended from the skein just sufficient to straighten the skein without removing the bulk. A second weight is suspended from the skein just sufficient to straighten the skein and remove the bulk but not sufficient to stretch the filaments. Percent shrinkage and percent bulk are calculated from the appropriate differences in length measurement as is well known.

Other physical properties of the yarn were measured. It was found that the yarn had an average break elongation of 51.1% as determined by standard ASTM methods. The performance of the process was excellent in that only 0.0065 breaks per pounds were experienced during the texturing operation. The yarn had an average tangle level of 4.1 tangles per foot (13.5 tangles per meter).

Tangles in the yarn were measured using a pin wheel tangle counting device. The tangle counting device consists of a wheel having a peripheral groove with needles set therein to engage the yarn. The wheel is set on a shaft that is loaded with a hysteresis brake to resist turning with a predetermined load. Yarn undergoing testing is pulled over the wheel with a needle slipping between the filaments. when a tangle is encountered, the shaft loading is overcome to rotate the wheel. A cam-switch assembly counts the number of times the wheel is advanced per unit length of yarn. A system of guides and tensioning devices is used to maintain proper yarn position so that one needle is in contact with the yarn at all times.

I claim:

1. Stuffer box yarn texturing apparatus comprising:

a. an aspirating hot fluid jet for heating, tangling, and longitudinally forwarding thermoplastic yarn from a source into and upwardly through an elongated stuffing chamber wherein the yarn is crimped and moves in the form of a plug;

b. means for cooling the yarn as it moves through the chamber;

c. a driven roll for withdrawing the yarn at an abrupt angle from the leading end of the moving yarn plug and pulling the yarn from the chamber; and d. a device in the yarn path between said chamber and said driven roll for controlling said abrupt angle at which the yarn is withdrawn from said chamber within the range of 90° ± 30° thereby controlling the distance that the yarn plug moves through the chamber whereby yarn of uniform bulk is provided, said device comprising (i) a base member; (ii) a plurality of closely spaced juxtaposed rod-like yarn guide members having different yarn engaging lengths and being slightly sequentially inclined first in one direction and then in the opposite direction; (iii) one end of each of said guide members being secured in said base; and (iv) the opposite ends of said guide members being bent in the same direction as the guide members are inclined, whereby the tension in the yarn moving in a serpentine path around said guide members is inversely related to the distance that the yarn is from the base member and whereby the crimp pattern of the yarn is rumpled by the yarn being in frictional contact with said guide members, said guide device being further characterized in that when the yarn angle is between 60° and 120° a given number of members are contacted by the yarn and when the yarn angle is less than about 60° or greater than about 120° a greater or lesser number, respectively, of members are contacted by the yarn, whereby the tangle level in the yarn is not significantly changed by changes in the yarn angle between 60° and 120°.

* * * * *

UNITED STATES PATENT AND TRADEMARK OFFICE

CERTIFICATE OF CORRECTION

PATENT NO. : 4,019,229

DATED : April 26, 1977

INVENTOR(S) : Pelham D. Chastang

It is certified that error appears in the above-identified patent and that said Letters Patent are hereby corrected as shown below:

Column 7, line 65, --75%-- should be inserted at the beginning of line 65.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*